US009651248B2

(12) United States Patent
Docquier et al.

(10) Patent No.: US 9,651,248 B2
(45) Date of Patent: May 16, 2017

(54) METHOD FOR GENERATING COMBUSTION BY MEANS OF A BURNER ASSEMBLY AND BURNER ASSEMBLY THEREFORE

(75) Inventors: Nicolas Docquier, Philadelphia, PA (US); Robert Kalcevic, Versailles (FR); Magnus Mortberg, Frankfurt am Main (DE); Remi Pierre Tsiava, Saint Germain-les-Corbeil (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 1034 days.

(21) Appl. No.: 13/061,418

(22) PCT Filed: Aug. 27, 2009

(86) PCT No.: PCT/EP2009/061097
§ 371 (c)(1),
(2), (4) Date: Feb. 28, 2011

(87) PCT Pub. No.: WO2010/023256
PCT Pub. Date: Mar. 4, 2010

(65) Prior Publication Data

US 2011/0146450 A1 Jun. 23, 2011

(30) Foreign Application Priority Data

Aug. 29, 2008 (EP) ..... 08105190

(51) Int. Cl.
*F23D 14/22* (2006.01)
*F23D 14/32* (2006.01)

(52) U.S. Cl.
CPC ..... *F23D 14/22* (2013.01); *F23D 14/32* (2013.01); *F23D 2900/00006* (2013.01); *F23D 2900/00013* (2013.01); *F23M 2900/05021* (2013.01)

(58) Field of Classification Search
CPC ..... F23D 14/22; F23D 14/32; F23D 2900/00006; F23D 2900/00013; C22B 9/00
(Continued)

(56) References Cited

U.S. PATENT DOCUMENTS 4,547,150 A 10/1985 Vereecke
5,302,112 A 4/1994 Nabors, Jr. et al.
(Continued)

FOREIGN PATENT DOCUMENTS

| | | |
|---|---|---|
| DE | 10 046 569 | 3/2002 |
| EP | 0 754 912 | 1/1997 |
| JP | 2000 146 129 | 5/2000 |

OTHER PUBLICATIONS

International Search Report for PCT/EP2009/061097, mailed Oct. 19, 2009.
Written Opinion for PCT/EP2009/061097, mailed Oct. 19, 2009.

*Primary Examiner* — Jie Yang
(74) *Attorney, Agent, or Firm* — Christopher J. Cronin

(57) ABSTRACT

A method for generating combustion by means of a burner assembly and corresponding burner assembly are disclosed. The burner assembly comprises a refractory block, a fuel supply system and an oxidant supply system. The refractory block defines along one plane P1 at least one fuel passageway extending from a fuel inlet port to a fuel outlet port, and along a second plane P2 at least one oxidant passageway extending from an oxidant inlet port to an oxidant outlet port, said first and second planes intersecting along a line that is beyond said outlet ports, said oxidant supply system
(Continued)

comprising a pair of oxidant supply means, an inlet of the inner oxidant supply means being connected to a source of a first oxidant having a first oxygen concentration and an inlet of the concentric outer oxidant supply means being connected to a source of a second oxidant having a second oxygen concentration, the method having improved flexibility in oxygen concentration in the oxidant.

10 Claims, 5 Drawing Sheets

(58) Field of Classification Search
USPC ..... 75/414
See application file for complete search history.

(56) References Cited

U.S. PATENT DOCUMENTS

| | | | | |
|---|---|---|---|---|
| 5,554,022 | A | 9/1996 | Nabors, Jr. et al. | |
| 6,783,357 | B2 * | 8/2004 | Joshi et al. | 431/161 |
| 2001/0023053 | A1 | 9/2001 | Hoke, Jr. et al. | |
| 2002/0192613 | A1 | 12/2002 | Legiret et al. | |
| 2003/0157450 | A1 | 8/2003 | Joshi et al. | |

* cited by examiner

METHOD FOR GENERATING COMBUSTION BY MEANS OF A BURNER ASSEMBLY AND BURNER ASSEMBLY THEREFORE

CROSS-REFERENCE TO RELATED APPLICATIONS

This application is a §371 of International PCT Application PCT/EP2009/061097, filed Aug. 27, 2009, which claims §119(a) foreign priority to European patent application 08105190.6, filed Aug. 29, 2008.

BACKGROUND

Field of the Invention

The present invention relates to methods for generating combustion in furnaces and burner assemblies therefore which include a refractory block, a fuel supply system and an oxidant supply system, the assemblies being configured to generate a flame downstream of the refractory block.

The present invention is particular suited for use in melting processes. It is notably, but not exclusively, suited for use in secondary metal, melting, in particular secondary aluminium melting, and ladle preheating.

Related Art

Melting processes generally comprise several phases or stages:

- a loading or charging phase in which the solid raw material is fed to the furnace,
- a melting phase in which the solid raw material is melted to form molten material,
- a maintenance, fining or refining phase in which the molten material is maintained in the molten state until it reaches a required level of homogeneity,
- a tapping or discharge phase, in which the refined molten material is removed from the furnace for further processing.

Different requirements of temperature, energy, etc. apply to the melting and fining phases. The most power or energy (per weight of material) is required during the melting phase, whereas less power or energy (per weight of material) is required during the fining phase.

Ladles can be used to carry molten material, in particular molten metal, from the melting furnace to a downstream installation, such as a ladle refining station or a casting station. These ladles are usually preheated to minimize thermal shock and damage to the refractory lining and to reduce temperature drop in the ladle.

Ladle preheating processes likewise generally comprise several phases or stages:

- An initial or primary phase of heating up the ladle vessel to an elevated temperature,
- A holding or temperature equilibrating phase when the ladle vessel is maintained at an elevated temperature, allowing a uniform temperature distribution throughout the refractory material The driving forces for cost reductions in melting industries, such as secondary melting industries, are mainly focused along two axes: the reduction of operation costs and the improvement of the process control. Important parameters are:

- reduction of energy costs,
- increase of productivity;
- improvement of the process control, which includes:
  - better stability of the atmosphere in furnaces;
  - larger abatement of pollution, such as NOx and black fumes containing impurities like dusts.

A specific parameter for secondary aluminium smelters is the reduction in the formation of dross (the mixture of salt, dirt, aluminium oxides and entrapped metallic aluminium that forms at the surface of the molten aluminium).

During the melting phase, which is the most energy consuming, it would be beneficial to use an oxidant with high oxygen content, so as to achieve a higher heat transfer to the raw material by radiation, thus accelerating the melting process, increasing energy efficiency and reducing energy consumption.

During the fining phase, in which inter alia temperature homogenization of the molten material takes place, less energy is required and fuel consumption is drastically lower. During this phase, lower oxygen participation (i.e. a lower oxygen concentration in the oxidant) could be used to minimize the operation costs, depending on the respective prices of fuel and oxygen.

An aluminium smelting process in which oxycombustion is used during the melting phase and in which air combustion is used during the holding phase is described in DE-A-10046569.

Furthermore, as will be discussed below, other benefits may be achieved in certain melting processes, such as secondary aluminium smelting, by using, during the fining phase, an oxidant, such as air, with a lower oxygen concentration.

In the case of ladle preheating, it is beneficial in the primary phase to use an oxidiser with high oxygen content, thus making it possible to reach the desired temperature as fast as possible and consequently to reduce the overall energy consumption. During the second temperature equilibrating phase, it can be beneficial to use a cheaper oxidiser with low oxygen content such as air since the energy requirements for this part of the process are lower. The operation costs can be minimized, depending on the respective prices of fuel and high oxygen oxidizer.

One family of prior art burner apparatus is disclosed in EP-A2-0754912, to which the reader is referred for further background information. In this state-of-the-art system, fuel and oxidant are introduced into the furnace through separate cavities in the burner assembly so that the fuel burns with the oxidant in a wide luminous flame, and whereby the combustion of the fuel with the oxidant generates reduced quantities of nitrogen oxides (NOx). Such a prior art burner apparatus provides both good energy efficiency and reduced production of pollutants (NOx). One problem with the apparatus described in EP-A2-0754912 is that it is limited to operation with an oxidant in the form of a gas having an oxygen molar concentration of at least 50%. This minimum oxygen requirement limits the flexibility of the apparatus.

US-A-2001/023053 discloses a burner block assembly which permits oxy-fuel, air-fuel, or an oxygen enriched air-fuel operation without replacing the burner block. However, combustion must be interrupted and the burner inlet arrangement must be modified when switching from oxy-fuel operation to air-fuel operation or to oxygen enriched air-fuel operation. US-A-2003/0157450 discloses a specific embodiment of this type of burner block assembly for the combustion of preheated fuel with preheated oxidant. According to one aspect of said embodiment, the burner block assembly comprises a conduit adapted to convey preheated oxidant and which extends through a plenum adapted to pass ambient temperature fluid into the annular region of the plenum surrounding the preheated oxidant conduit, thereby minimizing thermal stresses on burner parts and net heat loss. The ambient temperature fluid passing into the annular region surrounding the preheated oxidant conduit may itself be an oxidant and, in particular, an oxidant of different composition than the preheated oxidant.

U.S. Pat. No. 4,547,150 discloses a burner assembly with a central fuel injector and a co-axially surrounding oxidant injector, whereby the oxygen content of the oxidant can be varied from no oxygen enrichment (air-fuel combustion) to different levels of oxygen enrichment.

DE-A-10046569 and US-A-US2002192613 disclose pipe-in-pipe burners for use with two different oxidants with concentric fuel and oxidant injectors and a fuel-oxidant premixing chamber downstream of the fuel injector.

JP-A-2000146129 discloses a variable rate oxygen enrichment burner with a central fuel gas path and a coaxially surrounding air supply path, and a plurality of tube bodies surrounding the fuel gas path and positioned within the coaxial air supply path.

SUMMARY OF THE INVENTION

It is an object of the present invention to provide an improved method of generating combustion by means of a burner assembly (also referred to as "burner") and in particular to provide such a method having improved flexibility in oxygen concentration in the oxidant.

It is a further object of the present invention to provide a method of generating combustion by means of a burner assembly, the method having improved flexibility in oxygen concentration in the oxidant and being capable of providing a wide flame and low NOx combustion.

The present invention also relates to an improved burner assembly particularly suitable for use in said method.

Accordingly, the present invention provides a method of generating combustion by means of a burner assembly, said burner assembly comprising a refractory block, a fuel supply system and an oxidant supply system. The refractory block defines along one plane (hereafter referred to as the 'first plane) at least one fuel passageway extending from a fuel inlet port to a fuel outlet port, and substantially along a separate second plane at least one oxidant passageway extending from an oxidant inlet port to an oxidant outlet port, said first and second planes intersecting along a line that is beyond, i.e. downstream of, said outlet ports. The oxidant supply system comprises a pair of separate oxidant supply means: an inner oxidant supply means and an outer oxidant supply means. The inner oxidant supply means has an inlet connected in use to a source of a first oxidant. The outer oxidant supply means, which at least partially surrounds the inner oxidant supply means, has an inlet connected in use to a source of a second oxidant. The inner and the outer oxidant supply means extend at least partially into the at least one oxidant passageway, so that the oxidant supply system is configured in use to supply to the outlet port of said at least one oxidant passageway either just one of said first and second oxidants or a combination of both.

In the method of the invention, the burner assembly can thus be used to operate with and generate combustion with only the first oxidant, with only the second oxidant or with a combination of the first and the second oxidant.

The first and second oxidants typically have a different oxygen content (expressed in % vol. oxygen). Consequently, the use of the burner assembly makes it possible to vary the oxygen content of the oxidant supplied by the burner to the combustion process from the oxygen content of the first oxidant to the oxygen content of the second oxidant, and intermediate levels of oxygen content.

In the present context, the terms "oxidant" and "oxidiser" or "oxidizer" are synonymous.

When, with reference to the present invention, the term "oxidant" or "oxidiser" is used without the adjective "first" or "second", said term refers to the overall "oxidant" as injected by the burner into the combustion zone, whereby said "oxidant" may (a) correspond to the "first oxidant", when only the first oxidant is supplied to the burner, (b) correspond to the "second oxidant", when only the second oxidant is supplied to the burner, or (c) correspond to a combination of the "first" and "second oxidant", when both first and second oxidant are fed to the burner.

Typically, the second oxidant is an oxidant having an oxygen content below 25% vol., such as air. The first oxidant is advantageously an oxygen-rich oxidant having an oxygen content of from 70 to 100% vol., preferably from 90 to 100% vol., and more preferably from 95 to 100% vol.

The first and/or the second oxidant may be at ambient temperature or preheated. In general, they will either both be at ambient temperature or both preheated.

It is thus an advantage of the present invention that the new method offers a possibility of changing over the composition of the oxidant between oxygen and air, or a mix or combination of oxygen and air. It is therefore possible to introduce a portion of air, respectively oxygen into the oxidant in order effectively to change the oxygen content in the oxidant between 21% vol. (air) and 100% vol. (pure oxygen) or nearly 100% vol.

It is a particular advantage of the present invention that said changing over of the composition of the oxidant can be made without interruption the combustion process.

The inner oxidant supply means may stop short of said oxidant outlet port, such that the length of said oxidant passageway that extends between the outlet of said inner oxidant supply means and the orifice of said oxidant outlet port, defines a mixing chamber for pre-mixing said first oxidant with said second oxidant when the oxidant passageway supplies both the first and the second oxidant.

Inside the at least one oxidant passageway, said inner and outer oxidant supply means are preferably substantially concentric.

The oxidant supply system of the burner assembly may further comprise means to control the flow rate into said oxidant passageway of at least one, preferably both and most preferably both individually, of said first and second oxidants.

The burner assembly may comprise a plurality of oxidant passageways and a plurality of fuel passageways, both sets of passageways being spaced apart along their respective planes, said oxidant passageways being positioned above said fuel passageways such that said oxidant meets said fuel along the line of intersection between their respective planes, so as to generate a substantially planar flame front from said line of intersection and directed away from said refractory block.

The fuel passageway or each said fuel passageway may comprise a fuel injector nozzle having a clearance or passage surrounding it. In particular, means may be provided to bleed a portion of oxidant from said oxidant supply system into said fuel passageway, and more specifically into said surrounding clearance or passage, so that the bled-off oxidant is injected in the form of a shield surrounding the outside of said fuel injector nozzle, whereby in use said bled-off portion of said bled-off oxidant is injected through the fuel outlet port around the fuel injector nozzle. In this way, flame stability is increased.

Said oxidant bleed means are typically one or more tubes, pipes or passages fluidly connecting the oxidant supply system with the clearance of the fuel passageway or passageways.

One or each of said inner and outer oxidant supply means may be configured to supply an oxidant bleed into said fuel supply means, and in particular into a clearance or passage surrounding a fuel injector of said fuel supply means. The oxidant bleed means may thus in particular comprise:

- a first fluid connexion between the inner oxidant supply means and said clearance of said fuel passageway, so as to bleed a portion of the first oxidant into said clearance when the oxidant supply system supplies first oxidant to the outlet port of said at least one oxidant passageway, and
- a second fluid connexion between the outer oxidant supply means and said clearance of said fuel passageway, so as to bleed a portion of the second oxidant into said clearance when the oxidant supply system supplies second oxidant to the outlet port of said at least one oxidant passageway.

When the oxidant supply system supplies an oxidant consisting of a combination of the first and second oxidant to the outlet port of said at least one oxidant passageway, the above-described oxidant bleed means may similarly bleed a combination of the first and second oxidant into the clearance.

The burner may comprise a plurality of fuel passageways. Each of said fuel passageways may be equipped with fuel injectors for the injection of the same fuel or, alternatively two of said fuel passageways may be equipped with fuel injectors configured for the injection of different fuels.

Said fuel may be a hydrocarbon fuel, such as natural gas or heavy fuel oil. The fuel may also be a pulverized solid fuel.

The method of generating combustion of the present invention generates combustion by means of a burner apparatus according to any one of the embodiments described above, and includes:

(a) selectively supplying the inner oxidant supply means of an oxidant passageway of the refractory block with a first oxidant, said first oxidant advantageously containing at least 70% vol. of oxygen and preferably at least 90% vol. and more preferably at least 95% vol.

(b) selectively supplying the concentric outer oxidant supply means of same oxidant passageway with a second oxidant, said second oxidant preferably containing less than 25% oxygen, and being advantageously in the form of air;

(c) varying the ratio between said first and second oxidants being supplied to the at least one oxidant passageway between supplying only the first oxidant to the inner oxidant supply means (while not supplying the second oxidant to the outer oxidant supply means), supplying only the second oxidant to the concentric outer oxidant supply means (while not supplying the first oxidant to the inner oxidant supply means), and supplying a combination of the first oxidant to the inner oxidant supply means and of the second oxidant to the concentric outer oxidant supply means; and (d) directing said oxidant or oxidants towards a fuel for combustion therewith downstream of the burner.

Said method of generating combustion may furthermore include:

(c') supplying at least one fuel passageway with a fuel and injecting said fuel through the fuel outlet port of said at least one fuel passageway. Indeed, combustion may also be generated without the injection of fuel through the fuel outlet port, in particular when the atmosphere in the furnace contains a sufficient amount of combustible matter, which may, for example, have been released by the charge in the furnace, have been injected by other fuel supply means or which may remain following incomplete combustion.

The invention further covers the use of the method of generating combustion in a melting process, and in particular in a secondary melting process such as a secondary aluminium smelting process, and furthermore covers the use of the method of generating combustion in a ladle preheating process.

The invention also relates to improved burner assemblies as described above in connection with the method of generating combustion.

The present invention furthermore relates to furnaces equipped with at least one burner according to the invention. Said furnace may in particular be a rotary or reverbatory furnace, for example an aluminium smelter.

BRIEF DESCRIPTION OF THE FIGURES

The present invention will now be described by way of example and with reference to the accompanying drawings, in which.

DETAILED DESCRIPTION OF THE INVENTION

Figure 9:
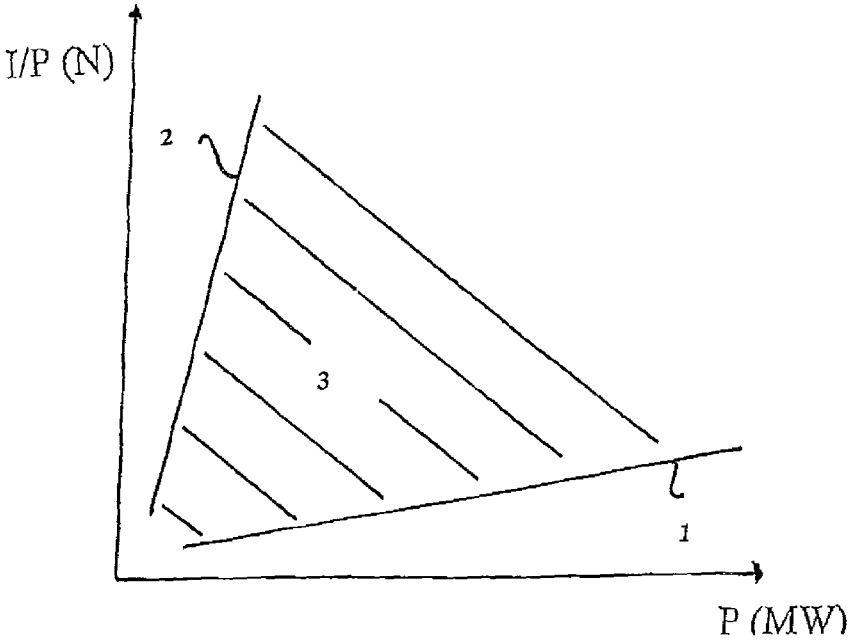
FIG. 9 is a graph schematically representing the ratio UP of total burner momentum over power (UP being expressed in N) of the burner assembly in function of the power P (P being expressed in MW) of the burner assembly, for the different ranges of operation of the burner assembly in the method of the invention.

In FIG. 9, line 1 represents the operation of the burner assembly in the method of the invention, using only substantially pure oxygen (first oxidant) as oxidant, line 2 represents the operation of the burner assembly in the method of the invention using only air (second oxidant) as oxidant, and zone 3 represents the operation of the burner in the method of the invention using a combination of first and second oxidant.

Referring to the drawings, a burner assembly 10 comprises a refractory block 12 through which are defined a series of passageways. The refractory block 12 may be a separate block or assembly of blocks, for example of ceramic. It may be integrated into a wall of a furnace.

Attached to the back of the refractory block 12 is a mounting bracket 14, a fuel supply system 18 and an oxidant supply system 20.

In the illustrated embodiment, the mounting bracket also supports an igniter 16. The presence of an igniter is optional, and may in particular not be required in furnaces, such as glass-melting furnaces, in which the temperature of the furnace atmosphere is sufficiently high to cause spontaneous ignition of the fuel with the oxidant.

The igniter 16 is configured to supply a pilot light/ignition flame through an igniter passageway 22 to a pilot jet orifice 24 on a furnace-facing front face 26 of the refractory block 12.

In the illustrated embodiment, the mounting bracket further supports a flame detector 50, typically a UV flame detector which is capable of detecting the presence or absence of a flame downstream of the burner through a separate flame detection passageway 52 through the refractory block 12. The presence of such a flame detector is likewise optional.

The fuel supply system 18 includes a fuel inlet port 28 for introducing fuel into one or several fuel passageways defined through the refractory block 12.

Figure 1:
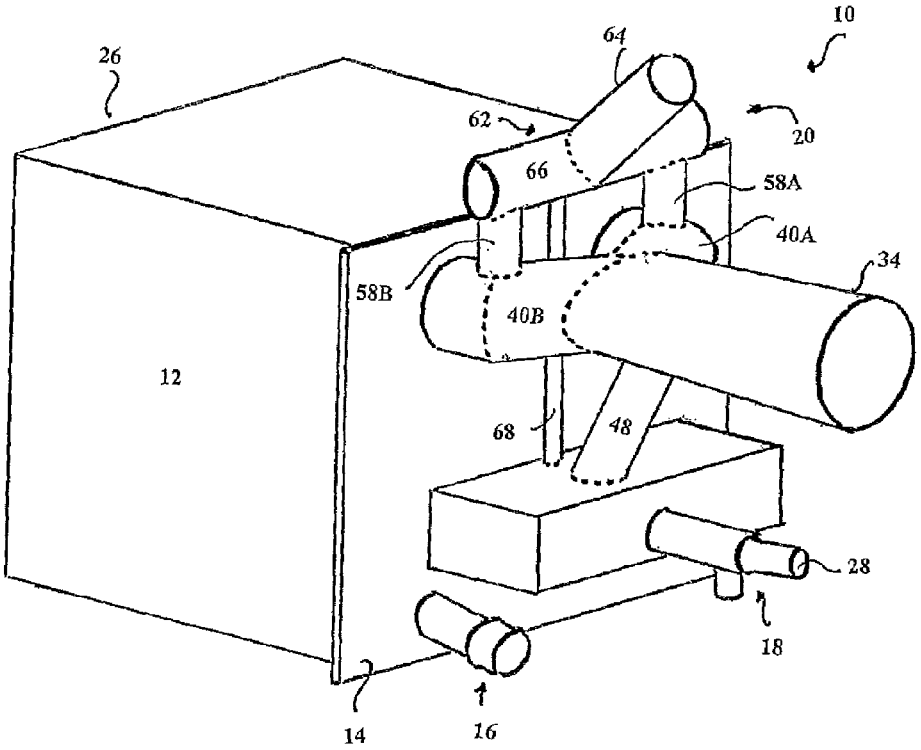
FIG. 1 is a perspective view of a burner assembly for use in a method of generating combustion according to a first embodiment of the present invention.
Figure 2:
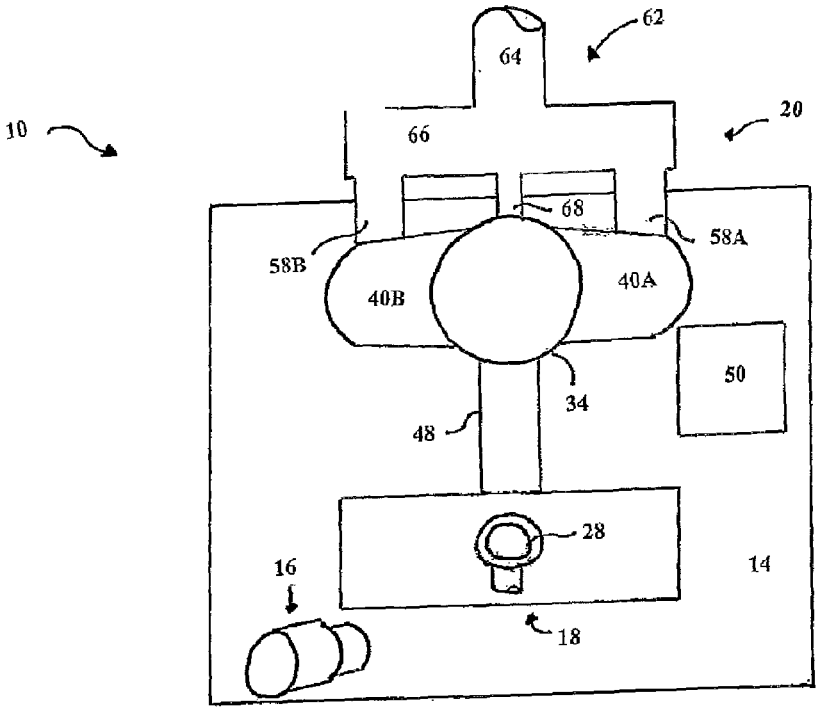
FIG. 2 is a rear elevation of the burner assembly of FIG. 1.
Figure 3:
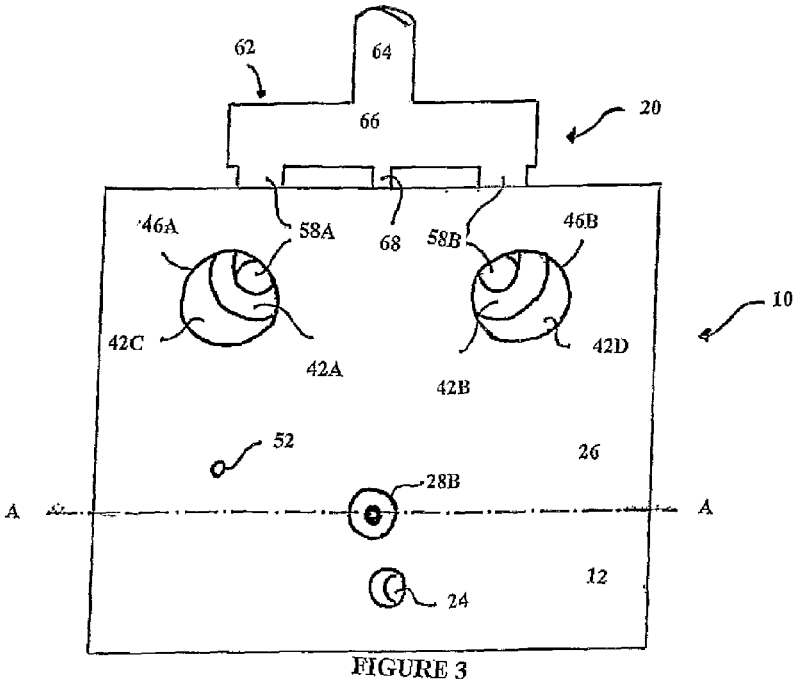
FIG. 3 is a front elevation of the burner assembly of FIG. 1.
Figure 4:
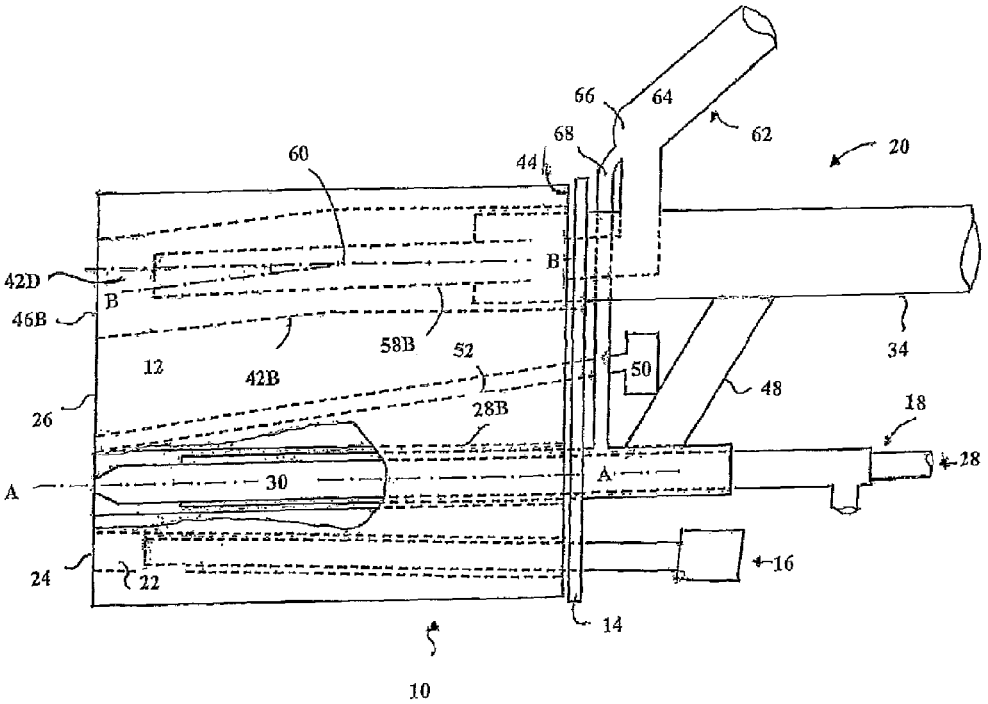
FIG. 4 is a side elevation of the burner assembly of FIG. 1, with a partial cutaway exposing a fuel injector.
Figure 5:
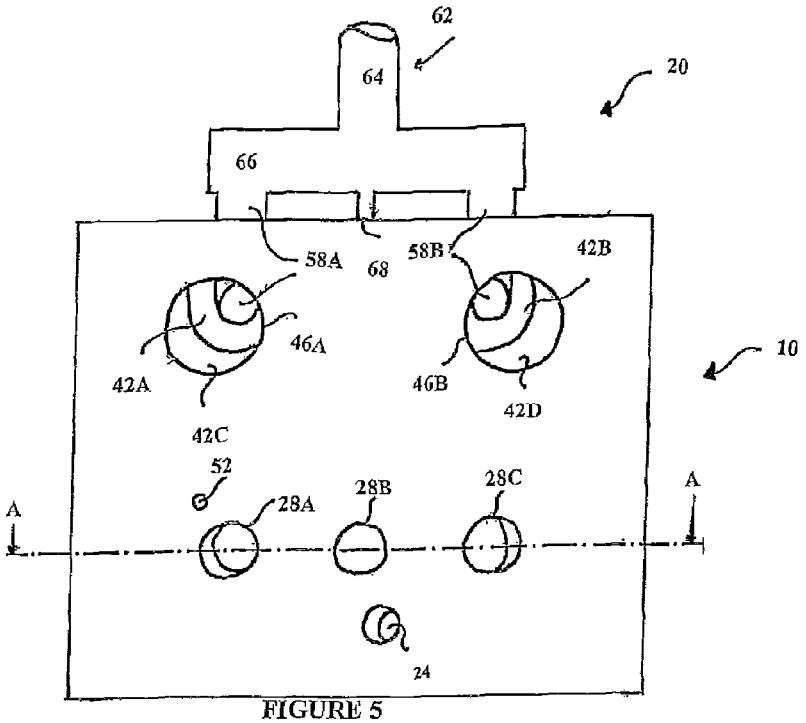
FIG. 5 is a front elevation view of a burner assembly for use in a method of generating combustion according to a second embodiment of the present invention.
Figure 6:
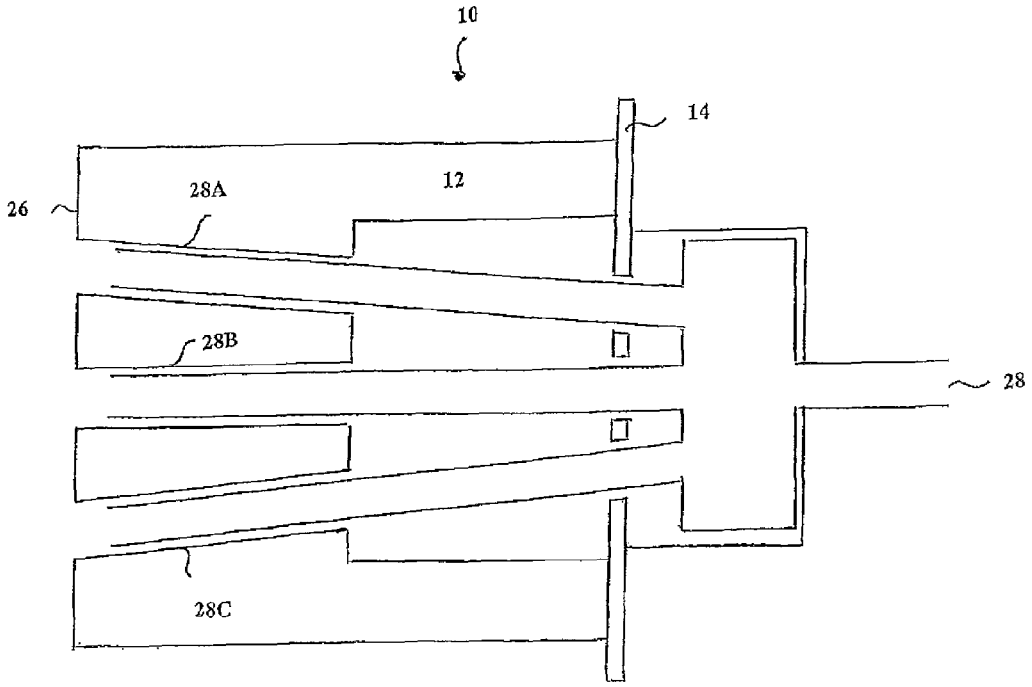
FIG. 6 is a cross-section through the front elevation of FIG. 5, along the line A-A.
Figure 7:
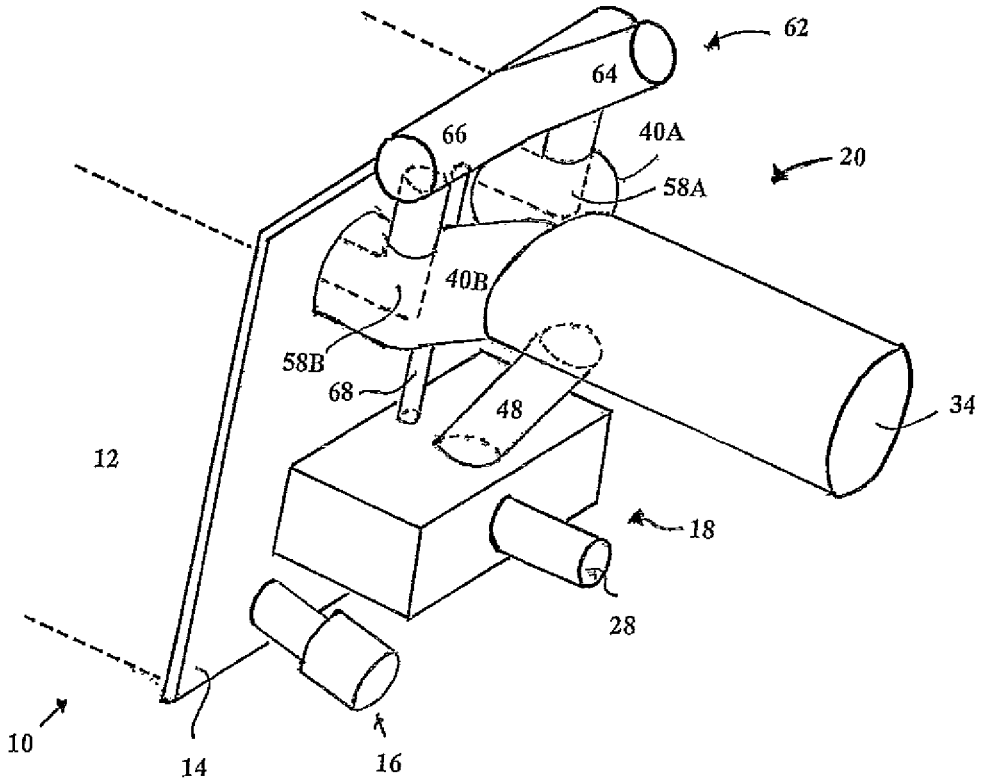
FIG. 7 is a perspective view the burner assembly of FIG. 5.
Figure 8:
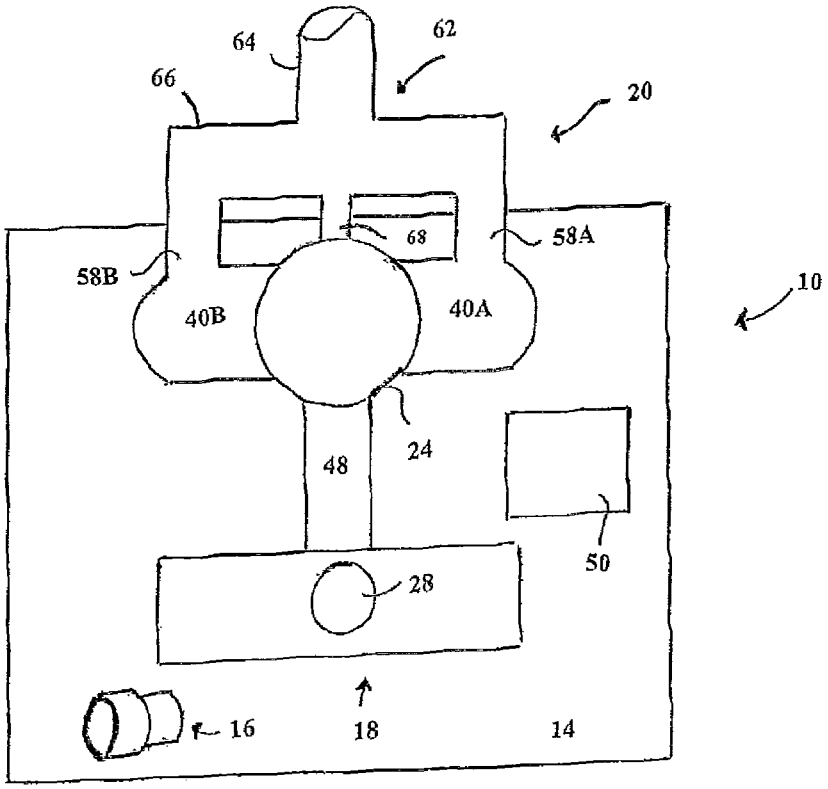
FIG. 8 is a rear elevation of the burner assembly of FIG. 5.

In the non-limiting embodiment illustrated in FIGS. 1 to 4, there is a single fuel passageway 28B which passes through the refractory block 12 on the plane P1, which lies across the lower half of the refractory block 12 and is represented by A-A in FIG. 3 and the associated view of FIG. 4. Fuel passageway 28B runs straight through the centre of the refractory block 12 on the plane P1 and has a liquid fuel atomiser 30 positioned along it. An inlet for atomising gas for the atomiser 30 is provided in the vicinity of fuel inlet port 28. In use, liquid fuel is supplied in atomized form via atomiser 30 centrally aligned along the central passageway 28B and is thus directed into the furnace away from the refractory block 12 along the same plane P1 on which lies the fuel passage 28B.

In the non-limiting embodiment illustrated in FIGS. 5 to 8, there are three fuel passageways 28A, 28B, and 28C for gaseous fuel. All three pass through the refractory block 12 on substantially the same horizontal plane P1, which lies across the lower half of the refractory block 12 and is represented by A-A in FIG. 5. One of the fuel passageways 28B runs straight through the centre of the refractory block 12 on the plane P1. The outer two fuel passageways 28A and 28C branch away horizontally outwards on the same plane P1 as the inlet port 28, but away from it, and exit the front face 26 of the refractory block 12 one each side of the central fuel passageway 28B. In use, the gaseous fuel is thus directed into the furnace away from the refractory block 12 in such a manner as to form a sheet along the same plane P1 on which lie the fuel passages 28A, 28B, and 28C.

The term "fuel" according to this invention includes hydrocarbon fuel in liquid or gaseous form. This means, for example, methane, natural gas, propane, atomized oil or the like (either in gaseous or liquid form) at either room temperature (25 DEG C) or in preheated form. The "fuel" may also be a pulverized solid fuel.

Alternative embodiments may comprise several fuel passages with associated atomizers or solid fuel lances, a single fuel passage or a combination of one or more liquid fuel passages with one or more gaseous fuel passages, etc. whereby when several fuel passages are present, these are advantageously situated on the same plane P1.

Turning now to the oxidant supply system 20, an oxidant inlet port 34 is positioned on the mounting bracket 14 above the fuel inlet port 28 and is configured to be connected to an oxidant source (referred to hereafter as "second oxidant source") for the supply of an oxidant (referred to hereafter as "second oxidant") for example in the form of air.

The inlet pipe 34 branches outwards in "Y" form into a pair of reduced diameter branch pipes 40A, 40B that turn back forwards just to the rear side of the mounting bracket 14, through which they pass and lead through a rear face 44 of the refractory block 12 into a pair of oxidant passageways 42A, 42B defined through the refractory block 12 from its rear face 44 to its front face 26.

The oxidant passageways 42A, 42B pass approximately halfway through the refractory block 12 along respective centrelines co-planar with the centreline of inlet pipe 34 and therefore also on a plane substantially parallel to plane P1 of the fuel passageway 28B, respectively fuel passageways 28A, 28B and 28C.

At a point 60 about halfway through the refractory block 12, the oxidant passageways are angled downwards and exit the front face 26 of the refractory block 12 through respective oxidant outlet ports 46A, 46B. The downwards angle of the oxidant outlet port centrelines lies along a plane P2 that intersects the plane P1 of the fuel passageways 28A, 28B, 28C at a point that is spaced apart from the front face 26 of the refractory block 12. This ensures that the oxidant supply will meet the fuel supply at a point that is beyond their respective outlet ports 28A, 28B, 28C, 46A, 46B. The plane P2 is represented in the drawings by the drop in the line B-B to the left of the point 60 in FIG. 4. P2 may for example be angled downwards by 5°.

There is a tapping out of the large bore pipe 34, in the form of an oxidant bleed pipe 48, which is configured to bleed a portion of oxidant out of oxidant pipe 34 and down to the fuel box 18 (also known as "fuel block" or "fuel supply system"). The bled-off oxidant is then used to surround the injection of atomized liquid fuel or gaseous fuel or pulverized solid fuel as it comes out of the fuel passageway 28B, respectively out of the fuel passageways 28A, 28B, 28C, so as to maximise flexibility of operation and flame stability.

The oxidant supply system further comprises an additional and separate oxidant supply means, configured to supply oxidant from a further oxidant source (referred to hereafter as "first oxidant source") along the same oxidant supply passageways 42A, 42B as does the second oxidant supply 34, 40A, 40B.

The apparatus used to deliver the separate first oxidant supply (the oxidant supplied by the first oxidant source being hereafter referred to as "first oxidant" and having a higher oxygen content than the second oxidant) is in the form of an inner oxidant lance 58A, 58B, located one in each oxidant branch pipe 40A, 40B.

According to the illustrated embodiments, in the installed position, the oxidant lances 58A, 58B are straight and extend further beyond the point 60 in the oxidant passage 42A, 42B at which the oxidant passage 42A, 42B is angled downwards. The outlet of each of the oxidant lances 58A, 58B is thus substantially concentric along at least part of the length of their associated oxidant passages 42A, 42B, but, due to the downwards angle, the outlets of the oxidant lances 58A, 58B are higher up in those passageways 42A, 42B. This is best seen with particular reference to FIG. 4.

Such an embodiment, in which the oxidant lances 58A and 58B are only minimally directed downwards, is particularly useful in furnaces containing a charge, situated below the burner, which is susceptible to unwanted oxidation. In that case, when the burner according to the invention injects only the second oxidant having a low oxygen content, such as air, into the furnace, said second oxidant is injected downwards towards the charge, thereby increasing convective heat transfer to the charge. As this second oxidant has only a low oxygen concentration, there is little or no oxidation of the charge. When, on the other hand, only the first oxidant, which has a high oxygen content, is injected into the furnace, oxidation of the charge by the oxidant is limited or prevented as the first oxidant is only slightly inclined towards the charge and there is little or no direct contact between the first oxidant and the charge, the first oxidant being entirely or almost entirely consumed during combustion of the fuel before reaching the charge. When a combination of first and second oxidant is injected, the overall oxygen concentration of the oxidant is situated between the oxygen concentration of the first oxidant and the oxygen concentration of the second oxidant, and the overall injection direction of the oxidant is likewise in between the injection direction when only the first oxidant is injected and the injection direction when only the second oxidant is injected. It will be appreciated that, when the furnace contains a charge which is not or only slightly susceptible to unwanted oxidation, both the oxidant passages and the oxidant lances may be directed (downwards) towards the charge in order to increase convective heat transfer.

The oxidant lances 58A, 58B stop short of their respective outlets of the oxidant passageways 42A, 42B and the region of the oxidant passageways 42A, 42B that lies in between the ends of the oxidant lances 58A, 58B and those outlets defines respective pre-mixing chambers 42C, 42D. The pre-mixing chambers 42C, 42D serve to homogenise the mixture between the two separately drawn oxidants prior to discharge, in the event that both oxidant supplies might be in use simultaneously.

The supply side of each oxidant lance 58A, 58B is connected to an oxidant supply means 62 that is separated from the oxidant supply that feeds into the large bore oxidant inlet port 34. The connection to the separate oxidant supply is in the form of a tubular spigot 64 that joins a log manifold 66 in its centre, the log manifold 66 spanning horizontally over the branch pipes 40A, 40B.

The oxidant lances 58A, 58B themselves are in the form of L-shaped tubes that drop down from the end regions of the log-manifold 66 and extend into the branch pipes 40A, 40B at the point at which those branch pipes 40A, 40B straighten up and go into the oxidant passageways 42A, 42B. In this manner, the oxidant lances 58A, 58B need only one elbow so as to turn along the oxidant passageways 42A, 42B.

There is a narrow bore pipe 68 tapped off the log manifold 66, which drops down into the fuel box 18. In similar fashion to the oxidant bleed pipe 48 that is taken out of the large bore pipe 34, this narrow bore pipe is configured to bleed a portion of the separate first oxidant supply out of the log manifold down to the fuel box 18. As with the other bleed pipe 48, the oxidant bled-off by the narrow bore bleed pipe is also used to surround the injection of atomized liquid fuel or of gaseous fuel as it comes out of respectively the fuel passageway 28B or the fuel passageways 28A, 28B, 28C, so as to improve flame stability and operation flexibility.

By providing an oxidant bleed pipe 48, 68 off each oxidant supply, the structure of the preferred embodiment ensures that there is always a supply of bled-off oxidant around the gaseous fuel injection for flame stabilisation, regardless of which oxidant supply is being used, either alone or in combination with the other. Flame stabilisation is in this case achieved by injection of some of an oxidant around the fuel injector and the remainder at some distance from the fuel injector.

The method of the invention using this specific design of the burner permits:

(a) to vary the oxygen the oxygen content of the oxidant by controlling the ratio between the first and second oxidant, (b) to control the injection velocities of the oxidant, regardless of whether only the first, only the second or a combination of both oxidants is injected, (c) to obtain wide, and consequently more homogeneous, flame coverage of the charge due to the multiple oxidant passageways, and (d) to ensure low intensity combustion reaction that gives very low emissions of oxides of nitrogen (NOx) for this type of burner design.

The NOx emissions are minimal when the oxidant consists essentially of pure oxygen, but tend to rise as oxygen levels in the oxidant decrease and nitrogen levels correspondingly increase.

The present invention provides the physical structure for two separate supplies of oxidant into a furnace and enables flexible use of those oxidants, either completely one or the other, or any mixture between the two. One oxidant may for example be air and the other oxygen, such that operation can take place from 21% oxygen concentration (air only) through to 100% oxygen or substantially 100% oxygen.

Aluminium use has increased more than any other metal in recent years and a growth rate greater than that of the other metals is also expected for many years to come. Today nearly 30% of the world production of aluminium results from recycling.

Secondary aluminium melting is done in reverbatory or rotary furnaces and the particularly high price of fuel, in particular in Europe and Japan, makes the use of oxygen combustion increasingly interesting. Indeed, the ever-higher price of fuel justifies more and more the use of oxygen or air enriched with oxygen in melting furnaces, in order to decrease the energy consumption and related costs.

In accordance with the present invention, a batch aluminium smelting process, and in particular a secondary aluminium smelting process may be conducted as follows.

The smelting process is conducted in a furnace equipped with one or more burner assemblies according to the invention.

The first oxidant is an oxygen-rich gas having an oxygen content of at least 70% vol., and preferably at least 90% vol. and more preferably at least 95% vol.

The second oxidant has an oxygen content of not more than 25% vol. and is preferably air.

Said process includes the following phases:

a charging phase, a melting phase, a fining phase and a discharge phase.

Different requirements of temperature, energy, etc. apply to the melting and maintenance phases. The most power or energy (per weight of material) is required during the melting phase, whereas less power or energy (per weight of material) is required during the fining phase.

In accordance with the present invention, at the start of the melting phase, the one or more burner assemblies are operated so that the oxidant consists mainly (i.e. for more than 50% vol. and advantageously for more than 75% by volume) of the first oxidant. In other words, the main portion (more than 50% vol. and advantageously for more than 75% by volume) of the oxidant is provided by the inner oxidant supply means, the inlet of which is connected to a source of the first oxidant. Preferably the oxidant consists entirely of the first oxidant. In other words, the entirety of the oxidant is provided by said inner oxidant supply means supplying the oxygen-rich first oxidant gas.

At the end of the melting phase, the oxygen content of the oxidant is decreased by increasing the portion of the oxidant which consists of the second oxidant (i.e. air). This is achieved by increasing the ratio between (a) the supply (or flow or flow rate) of the second oxidant through the outer oxidant supply means and (b) the supply (or flow or flow rate) of the first oxidant through the inner oxidant supply means. This increase can be a stepwise increase or a gradual or progressive increase. Use is made thereto of the means of the burner assembly for controlling the respective flows. A gradual increase is preferable for reasons of flame stability.

During the fining phase, the one or more burner assemblies are operated so that the oxidant consists mainly (i.e. for more than 50% vol. and advantageously for more than 75% by volume) of the second oxidant, i.e. air. In other words, the main portion (more than 50% vol. and advantageously for more than 75% by volume) of the oxidant is provided by the outer oxidant supply means, the inlet of which is connected to a source of the second oxidant/air. During the fining phase, the oxidant preferably consists entirely of the second oxidant. In other words, the entirety of the oxidant is air provided by said outer oxidant supply means supplying the second oxidant which has a relatively low oxygen content, in particular air.

When the raw material contains combustible matter, for example lacquers, paint and oil present in scrap metal, this combustible matter may act as fuel in the early stages of the melting phase. During said early stages of the melting phase, the ratio between, on the one hand, the amount (flow or flow rate) of fuel supplied by the one or more burner assemblies through the one or more fuel outlet ports and, on the other hand, the amount (flow of flow rate) of oxygen supplied as part of the oxidant through the one or more oxidant outlet ports may temporarily be reduced. In this manner the fuel contribution of the raw material is taken into account.

When using the above method of the invention, the temperature rapidly increases at the start of the melting phase and melting occurs more rapidly. Energy efficiency is also increased due to the highly radiative flame and the consequent high radiative energy transfer to the charge.

During the fining phase, the aluminium is in molten form and at high temperature, which results in an increased risk of oxidation and consequent increased risk of loss of material formation of dross.

The risk of loss of material can be reduced by creating a substantially homogeneous or uniform temperature profile of the atmosphere above the charge along the furnace.

In practice, a reduction in the loss of material during the fining stage is achieved by operating, during the fining stage, the one or more burner assemblies so that the oxidant consists mainly and preferably entirely of air. This results in a higher momentum (I) to power (P) ratio of the one or more burner assemblies as illustrated by line 2 in FIG. 9. During said fining stage, the one or more burner assemblies can advantageously be operated, with air as the oxidant, so as to achieve an essentially homogeneous combustion above the charge and therefore also an essentially homogeneous and uniform temperature profile above the charge along the furnace.

As the energy requirement is lower during the fining phase, air can be used as the oxidant during this phase without reducing the overall efficiency of the melting process.

The use of air as oxidant during the fining phase entails the presence of nitrogen in the furnace atmosphere at this stage. However, this does not lead to substantial NOx formation due to the lower temperature of the air-fuel flame, as compared to the significantly higher temperatures of oxy-fuel flames.

Although the process of the invention has been described here above with respect to an aluminium melting process, it can also advantageously be used in other melting processes comprising a melting and a fining phase, such as, for example, glass melting processes, and in particular batch glass melting processes.

In accordance with the present invention, a ladle preheating process may be conducted as follows: an initial phase with the objective of heating up the ladle vessel to an elevated temperature. During this phase the oxygen content of the oxidiser is chosen to be high in order to increase the energy intensity of the process and consequently reducing the time necessary for the process step. A second phase, following the initial phase, is the holding phase in which the ladle vessel is maintained at an elevated temperature, allowing an uniform temperature distribution throughout the refractory material. During this second phase, the energy input is reduced in order to only maintain the desired temperature. Depending on the variable costs of fuel, oxygen and air the optimum mixture of oxygen and air can be chosen in order to obtain the lowest possible overall operational costs.

In accordance with the present invention, at the start of the initial phase, the one or more burner assemblies are operated so that the oxidant consists mainly (i.e. for more than 50% vol and advantageously for more than 75% by volume) of the first oxidant. In other words, the main portion (more than 50% vol and advantageously for more than 75% by volume) of the oxidant is provided by the inner oxidant supply means, the inlet of which is connected to a source of the first oxidant. Preferably the oxidant consists entirely of the first oxidant. In other words, the entirety of the oxidant is provided by said inner oxidant supply means supplying the oxygen-rich first oxidant gas, thereby accelerating the preheating of the ladle vessel.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

During the subsequent temperature equilibrating phase which has lower energy requirements, the one or more burner assemblies are operated so that the oxidant consists mainly (i.e. for more than 50% vol. and advantageously for more than 75% by volume) of the second oxidant, i.e. air. In other words, the main portion (more than 50% vol. and advantageously for more than 75% by volume) of the oxidant is provided by the outer oxidant supply means, the inlet of which is connected to a source of the second oxidant/air. During this phase, the oxidant preferably consists entirely of the second oxidant. In other words, the entirety of the oxidant is air provided by said outer oxidant supply means supplying the second oxidant which has a relatively low oxygen content, in particular air.

The present invention therefore allows a user to better adapt the oxidant composition to the cycle requirements, such as for example to furnace load or to the power requirements in the melting cycle. In addition or in the alternative, the furnace can also be optimized to the instantaneous market price of oxidants and fuel, e.g. 100% oxygen when the fuel is expensive and 100% air when fuel is cheap, or any mixture between the two.

It is also of note that the structure disclosed herein is permanently in place and therefore does not need physical connections to be remade so as to swap between the oxidants it can supply and a stepwise swap or progressive change can therefore be made without interrupting the operation of the burner assembly.

What is claimed is:

1. A method of generating combustion by means of a burner assembly comprising a refractory block, a fuel supply system and an oxidant supply system including an inner oxidant supply and an outer oxidant supply, the oxidant being supplied comprising first and second oxidants, wherein:

multiple fuel passageways extend along a first plane through the refractory block from a fuel inlet port to a fuel outlet port, multiple oxidant passageways extend through the refractory block from an oxidant inlet port to an oxidant outlet port, each of the oxidant passageways comprising an upstream portion extending from said oxygen inlet port along a plane, each of the oxidant passageways comprising a downstream portion terminating at said oxygen outlet port and extending along a second plane that intersects said first plane along a line beyond said outlet ports, said upstream portions are angled to respective ones of said downstream portions so as to form a bend in each of said oxidant passageways, said inner oxidant supply comprising multiple straight oxidant lances each one of which is concentrically disposed within a respective one of said upstream portions and extends to a point in between a respective one of said bends and said oxidant outlet port, said oxidant lances fluidly communicating with a source of a first oxidant, said outer oxidant supply comprising multiple spaces each of which is defined by an outer surfaces of a respective one of said oxidant lances and an inner surface of a respective one of said oxidant passageways, said spaces fluidly communicate with a source of a second oxidant, the method comprising the steps of:

(a) selectively supplying the lances with a first oxidant, said first oxidant containing at least 70% vol. of oxygen;

(b) selectively supplying the spaces with a second oxidant, said second oxidant being air;

(c) melting a charge in a furnace using the burner assembly with heat from the combustion of oxidant and the fuel; and (d) varying the ratio between said first and second oxidants being supplied to the lances and spaces, respectively, said step of varying the ratio comprising:

supplying oxidant to the lances and spaces at the start of a melting phase such that at least 50% of the oxidant is supplied as the first oxidant to said lances for combustion with the fuel downstream of the burner assembly and not the second oxidant, at the end of the melting phase, a ratio between a flow of the second oxidant through the outer oxidant supply and a flow of the first oxidant through the inner oxidant supply is increased; and during a fining phase following the melting phase, the burner assembly is operated so that more than 50% vol. of the oxidant supplied by the burner assembly is second oxidant provided by the outer oxidant supply.

2. The method of claim 1, wherein portions of said upstream portions between said bends and said oxidant oulet port define respective mixing chambers for pre-mixing said first oxidant with said second oxidant when said first oxidant is supplied to said lances at the same time second oxidant is supplied to said spaces.

3. The method of claim 1, wherein the oxidant passageways are positioned above the fuel passageways in the refractory block.

4. The method of claim 1, whereby said oxidant supply system further comprises means controlling the flow rate into said oxidant passageway of at least one of said first and second oxidants.

5. The method of claim 1, wherein the or each said fuel passageway comprises a fuel injector nozzle having a clearance surrounding it, and wherein means are provided which bleed a portion of oxidant from said oxidant supply system into said clearance of said fuel passageway, said oxidant bleed means being configured to feed its bled-off oxidant in the form of a shield surrounding the outside of said fuel injector nozzle.

6. The method of claim 5, wherein said oxidant bleed means comprises a first connexion between the inner oxidant supply means and said clearance of said fuel passageway which bleeds a portion of the first oxidant into said clearance of said fuel passageway when said oxidant supply system supplies first oxidant to the outlet port of said at least one oxidant passageway and whereby said oxidant bleed means further comprises a second connexion between the outer oxidant supply means and said clearance of said fuel passageway which bleeds a portion of the second oxidant into said clearance of said fuel passageway when said oxidant supply system supplies second oxidant to the outlet port of said at least one oxidant passageway.

7. The method of claim 1, wherein said fuel comprises a hydrocarbon fuel comprising natural gas or heavy fuel oil or pulverized solid hydrocarbon fuel.

8. The method of claim 1, wherein heat from the combustion is used in a melting process or melting furnace.

9. The method of claim 1, wherein heat from the combustion is used to preheat a ladle.

10. The method of claim 1, whereby heat is provided by the one or more burner assemblies by combusting fuel with oxidant, said process including:

an initial heating up phase, a subsequent temperature equilibrating phase, and whereby:

during the heating up phase, the one or more burner assemblies are operated so that more than 50% vol. is first oxidant provided by the inner oxidant supply, the inlet of which is connected to a source of the first oxidant, and during the temperature equilibrating phase, the one or more burner assemblies are operated so that more than 50% vol. and more preferably the totality of the oxidant is second oxidant provided by the outer oxidant supply, the inlet of which is connected to a source of the second oxidant.

* * * * *